US007176951B2

(12) United States Patent
Asakura

(10) Patent No.: US 7,176,951 B2
(45) Date of Patent: Feb. 13, 2007

(54) RECORDING MATERIAL SUPPLY DEVICE AND IMAGE FORMING APPARATUS

(75) Inventor: Hiroyuki Asakura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 232 days.

(21) Appl. No.: 11/024,833

(22) Filed: Dec. 30, 2004

(65) Prior Publication Data

US 2005/0146587 A1 Jul. 7, 2005

(30) Foreign Application Priority Data

Jan. 7, 2004 (JP) ..... 2004-002399

(51) Int. Cl.

| | |
|---|---|
| ***B65H 29/58*** | (2006.01) |
| ***B65H 16/00*** | (2006.01) |
| ***B65H 20/00*** | (2006.01) |
| ***B41J 15/18*** | (2006.01) |

(52) U.S. Cl. ..... 347/139; 347/153; 347/262; 347/264; 347/218; 347/104; 355/72

(58) Field of Classification Search ..... 347/104, 347/139, 153, 262, 264, 218, 157; 355/72
See application file for complete search history.

(56) References Cited

U.S. PATENT DOCUMENTS

| | | | |
|---|---|---|---|
| 5,438,388 | A | 8/1995 | Arimoto et al. |
| 5,934,167 | A | 8/1999 | Yamamoto |
| 2005/0117012 | A1 * | 6/2005 | Konagaya ..... 347/157 |

* cited by examiner

*Primary Examiner*—Huan Tran
(74) *Attorney, Agent, or Firm*—Sughrue Mion, PLLC

(57) ABSTRACT

A photographic printer removably holds a magazine for containing a roll of photographic paper is provided. The photographic paper is advanced and supplied to a transporting path. A large-width loading support is loaded with a large-width magazine removably. A small-width loading support is loaded with plural small-width magazines removably. The small-width magazines have a smaller width than the large-width magazine, and are arranged in a path crosswise direction that extends along a width of the transporting path. As viewed from the large width loading support, the small-width loading supports are arranged in a vertical direction that is perpendicular to the path crosswise direction. Furthermore, a cutter cuts the photographic paper to form a photographic paper sheet.

35 Claims, 5 Drawing Sheets

RECORDING MATERIAL SUPPLY DEVICE AND IMAGE FORMING APPARATUS

BACKGROUND OF THE INVENTION

1. Field of the Invention

The present invention relates to a recording material supply device and image forming apparatus. More particularly, the present invention relates to a recording material supply device easily loadable with plural magazines for recording materials such as photographic paper, and image forming apparatus having the recording material supply device.

2. Description Related to the Prior Art

A photographic printer as image forming apparatus is used in a photo laboratory, for example a printer-processor composite machine in which a photographic paper processor is combined with the printer. A photographic paper magazine is removably set on the printer, and contains a roll of photographic paper as recording material. The printer prints an image to the photographic paper unwound and advanced from the magazine. The photographic paper is subjected to color development and dried, to produce photographic prints. The magazine has a size predetermined according to the maximum web width of the photographic paper in use. Conventionally used types of magazines have a considerably large side, so only one or two magazines can be set in a supply device of the photographic paper for the printer. In addition, only one or two sizes are available for the photographic paper for the purpose of image recording without exchanging magazines in the printer. If the photographic paper of a size different from that of the loaded type of the photographic paper, the exchange of magazines is required.

U.S. Pat. No. 5,438,388 (corresponding to JP-A 6-347913) disclose an example of the photographic printer with a magazine from which the photographic paper is advanced in a direction perpendicular to a transporting path for image forming with the photographic paper. U.S. Pat. No. 5,934,167 (corresponding to JP-A 7-261281) discloses examples of the printer in which plural magazines are disposed on two sides defined by the transporting path, and also arranged on the transporting path one after another.

However, the known types of the photographic printer have problems in their extremely great size due to the disposition of the magazines on one side or two sides of the transporting path. The printer of U.S. Pat. No. 5,438,388 (corresponding to JP-A 6-347913) includes a transporting direction changer for the purpose of suitably directing the photographic paper advanced perpendicularly to the transporting path for the printing. A problem arises in the complicated structure of the printer to increase a manufacturing cost. Also, a problem in U.S. Pat. No. 5,934,167 (corresponding to JP-A 7-261281) lies in that the transporting path is remarkably long to enlarge the printer considerably because of the great number of the magazines used at one time.

SUMMARY OF THE INVENTION

In view of the foregoing problems, an object of the present invention is to provide a recording material supply device easily loadable with plural magazines for recording materials such as photographic paper, and image forming apparatus having the recording material supply device.

In order to achieve the above and other objects and advantages of this invention, a recording material supply device removably holds a magazine for containing a recording material roll of recording material, for advancing and supplying the recording material from the magazine to a transporting path where an image forming device is disposed. In the recording material supply device, a first loading unit is loaded with a large-width magazine removably, the large-width magazine being adapted to containing a large-web-width type of the recording material roll. A second loading unit is disposed beside the first loading unit in a first direction that is perpendicular to a transporting surface of the transporting path, for being loaded with plural small-width magazines removably, the small-width magazines being adapted to containing a small-web-width type of the recording material roll having a smaller width than the large-web-width type of the recording material roll, and being arranged in a second direction that extends along an axis of the recording material roll in the first loading unit.

Each of the large and small-width magazines includes a support shaft for extending in the second direction and for supporting the roll of the recording material in a rotatable manner.

Furthermore, plural transporting mechanisms transport the recording material from each of the small-width magazines.

Furthermore, a cutter cuts the recording material to form a recording sheet.

The first and second loading units have respectively a unitary form. Furthermore, a retaining mechanism removably retains the first and second loading units.

The large and small-width magazines include a storage medium for storing information related to the recording material. Each of the first and second loading units includes an information reader for reading the information from the storage medium.

The recording material of the small-width magazines is different in a width to one another in the second direction.

In another preferred embodiment, the recording material of the small-width magazines is equal in a width to one another in the second direction.

The plural small-width magazines include first and second small-width magazines. Furthermore, a controller controls the plural transporting mechanisms, for causing the recording material to advance from the first small-width magazine, and for causing the recording material to advance from the second small-width magazine continuously after using up of the recording material from the first small-width magazine.

The first direction is substantially vertical, and the small-width magazines are arranged in two or more groups in a series extending substantially vertically.

The two or more groups of the small-width magazines comprise at least first, second and third groups. The second group is disposed substantially above the first group, and the third group is disposed at a height between heights of the first and second groups, and offset therefrom horizontally.

In one preferred embodiment, a first recording material in the large-width magazine has a first width, and a second recording material in the small-width magazines has a second width smaller than the first width. The large-width magazine is adapted to contain any of the first and second recording materials.

A roll diameter of the roll of the recording material in the small-width magazines is greater than a roll diameter of the roll of the recording material in the large-width magazine.

The plural small-width magazines include two or three small-width magazines.

In still another preferred embodiment, the plural small-width magazines comprise first and second small-width magazines. The first and second small-width magazines include respectively first and second exit channels for advancing the recording material. The second loading unit includes a first support for supporting the first small-width magazine. A second support supports the second small-width magazine by directing the second exit channel to the first exit channel of the first small-width magazine on the first support. An aligning mechanism bends a path of a first recording material from the first exit channel in a first bending direction, bends a path of a second recording material from the second exit channel in a second bending direction reverse to the first bending direction, to align and guide the first and second recording materials toward the transporting path.

In one preferred embodiment, the plural small-width magazines comprise first and second small-width magazines. The first and second small-width magazines include respectively first and second exit channels for advancing the recording material. The second loading unit includes a first support for supporting the first small-width magazine. A second support is positioned at a different height from the first support and offset therefrom substantially horizontally, for supporting the second small-width magazine by directing the second exit channel substantially in parallel with the first exit channel of the first small-width magazine on the first support.

The first and second loading units are arranged in a third direction that is perpendicular to both of the first and second directions.

According to one aspect of the invention, an image forming apparatus comprises a recording material supply device for supplying recording material on a transporting path, the recording material supply device including a first loading unit for being loaded with a large-width magazine removably, the large-width magazine containing a roll of recording material, and a second loading unit for being loaded with plural small-width magazines removably, the small-width magazines having a smaller width than the large-width magazine, being arranged in a second direction crosswise to the transporting path, for respectively containing a roll of recording material. The first and second loading units are arranged in a first direction that is perpendicular to the second direction. There is an image forming device for image forming on the recording material. A shifting mechanism is positioned upstream from the image forming device, for shifting the recording material in the second direction on the transporting path for position adjustment.

Furthermore, a cutter cuts the recording material to form a recording sheet. The shifting mechanism shifts the recording sheet.

The cutter produces the recording sheet by cutting the recording material from one of the small-width magazines, and the shifting mechanism distributes the recording sheet into plural rows for supply to the image forming device.

The shifting mechanism sets the recording sheet from the small-width magazines on a centerline of the recording sheet from the large-width magazine.

In another preferred embodiment, plural recording sheets in series in the second direction are subjected to image forming simultaneously by the image forming device.

The transporting mechanisms transport a plurality of the recording material from the plural small-width magazines toward the image forming device with an interval between the plurality of the recording material unchanged.

The image forming device includes a maximum recordable widthwise range equal to or greater than a widthwise range where plural recording materials from the plural small-width magazines has on the transporting path, the maximum recordable widthwise range being defined where the image forming device is capable of image forming.

In one preferred embodiment, the shifting mechanism reduces an interval between plural recording sheets according to the second direction before the image forming device operates.

In still another preferred embodiment, the shifting mechanism causes transport of the recording sheet in a zigzag form in plural rows.

The small-width magazines comprises four small-width magazines disposed in a 2×2 matrix according to the first and second directions. Furthermore, a controller controls the transporting mechanisms to transport the recording materials simultaneously from two of the four small-width magazines arranged diagonally with respect to the matrix.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
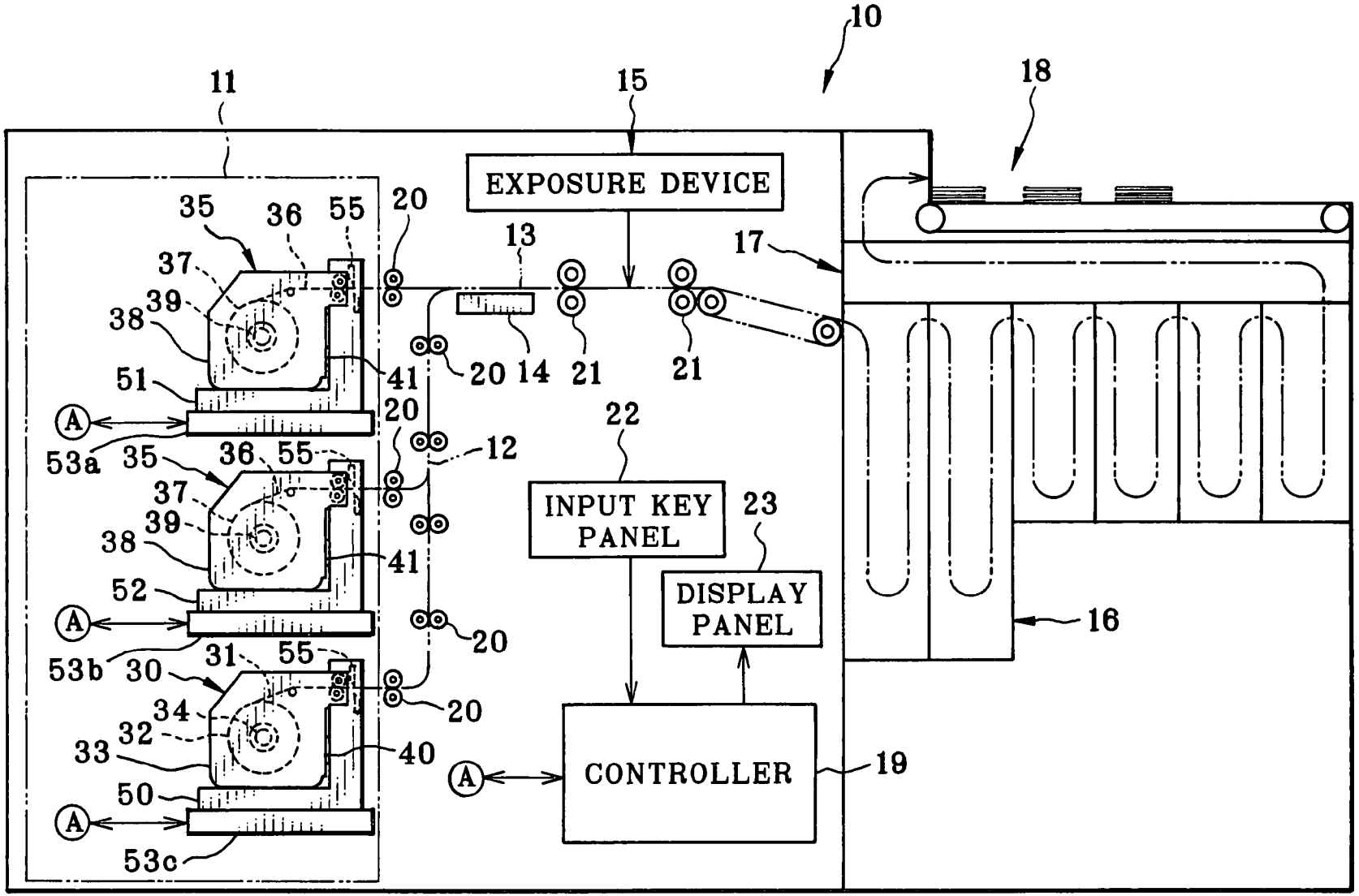
FIG. 1 is an explanatory view in vertical section, illustrating a printer-processor composite machine.

In FIG. 1, a printer-processor composite machine 10 as a photographic printer is illustrated. As recording material, photographic paper is used in the printer-processor composite machine 10 as one of photosensitive materials. The printer-processor composite machine 10 includes a recording material supply device 11, transporting paths 12 and 13, a shifting distributor 14, an image forming exposure device 15, a processing bath group 16, a drier 17, a stacker 18, and a system controller 19. The recording material supply device 11 supplies photographic paper. The transporting path 12 is formed to extend in a vertical direction that is a first direction, and causes transport of the photographic paper. The shifting distributor 14 is a widthwise shifting mechanism to shift the photographic paper relative to the transporting path 13. The exposure device 15 is an image forming device to form an image by exposing the photographic paper. The processing bath group 16 photographically develops the photographic paper being exposed. The drier 17 dries the photographic paper. The stacker 18 stacks paper sheets of the photographic paper after the image forming operation. The controller 19 controls various elements in the entirety of the printer-processor composite machine 10. The transporting paths 12 and 13 are constituted by a guiding mechanism and various transporting roller sets 20 and 21 as transporting mechanism, which transports the photographic paper in the recording material supply device 11, the transporting paths 12 and 13, the shifting distributor 14, the exposure device 15, the processing bath group 16, the drier 17 and the stacker 18. Also, there are plural sets of transport rollers (not shown) in the processing bath group 16 and the stacker 18, for transporting the photographic paper through the transporting path 13.

An input key panel 22 and a display panel 23 are connected with the controller 19. The input key panel 22 is operable by manual operation of an operator. The display panel 23 displays a menu pattern for various menus of settings. The controller 19 retrieves command signals from the input key panel 22 at the operator, and controls the various devices 11–18, to print an image by image forming of the photographic paper.

Figure 2:
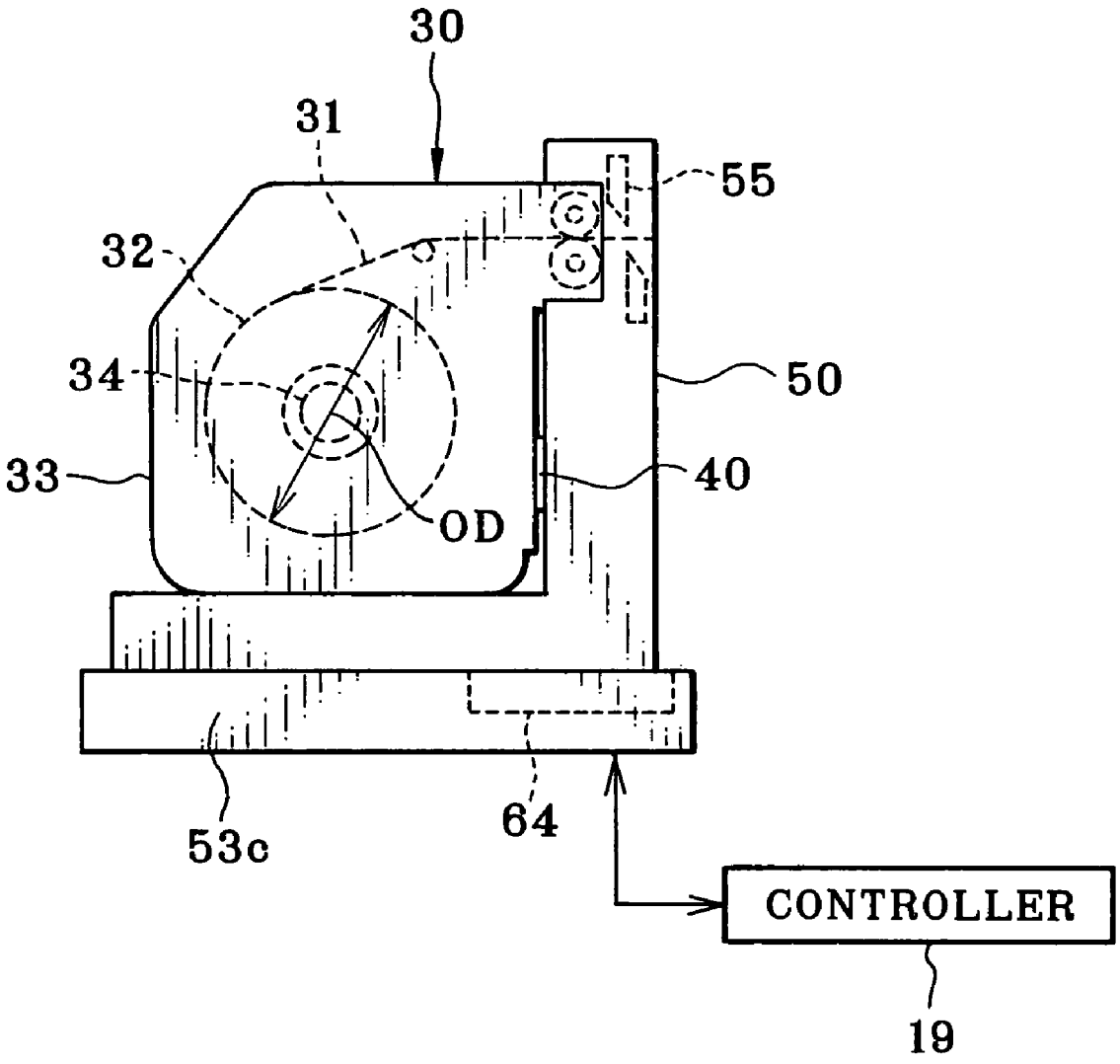
FIG. 2 is a side elevation illustrating a magazine for photographic paper.

A magazine for containing photographic paper is loaded in the recording material supply device 11 removably. The recording material supply device 11 is constructed suitably for two magazines that are different in the size of the magazine body. In FIG. 2, a large-width magazine 30 includes a magazine body 33 and a support shaft 34. The magazine body 33 contains a photographic paper roll 32 as recording material roll obtained by winding photographic paper 31 as recording material. The support shaft 34 supports the paper roll 32 in a rotatable manner inside the magazine body 33, the support shaft 34 extending in a path crosswise direction that is a second direction. The support shaft 34 is so oriented as to extend in parallel with a path crosswise direction of the transporting path 13 when the large-width magazine 30 is set in the recording material supply device 11. The magazine body 33 has a size suitable for photographic paper with the largest width that is 305 mm or 12 inches. Consequently, the width of the magazine body 33 itself is approximately 400 mm as 305 mm plus 100 mm, because of dimensions of the holders or other elements associated with the paper roll 32 in addition to the thickness of the magazine body 33.

Each of small-width magazines 35 is constructed basically the same as the large-width magazine 30, and includes a magazine body 38 and a support shaft 39. The magazine body 38 contains a photographic paper roll 37 as recording material roll obtained by winding photographic paper 36 as recording material. The support shaft 39 supports the paper roll 37 in a rotatable manner inside the magazine body 38, the support shaft 39 extending in the path crosswise direction. The support shaft 39 is so oriented as to extend in parallel with the path crosswise direction when the small-width magazine 35 is set in the recording material supply device 11. The magazine body 38 has a size suitable for photographic paper having a width of 152 mm, which is the KG size width. The width of the magazine body 38 itself is approximately 250 mm, which is half as much as that of the large-width magazine 30. It is possible to load the two small-width magazines 35 into a space where the large-width magazine 30 is settable.

The photographic paper 31 in the large-width magazine 30 has a length of approximately 90 meters in an unwound state. An outer diameter OD of the paper roll 32 is approximately 200 mm. The photographic paper 36 in the small-width magazine 35 has a length of approximately 180 meters in an unwound state. An outer diameter OD of the paper roll 37 is approximately 300 mm. Thus, the large-width magazine 30 has a smaller shape as viewed in the section than that of the small-width magazine 35.

In FIG. 2, an identification storage medium 40 or ID chip is secured to a front panel of the large-width magazine 30, and stores information of the photographic paper type of the photographic paper 31 in the magazine body 33, the width, the remaining amount, the initial date of the use, and the like. Also, an identification storage medium 41 or ID chip is secured to a front panel of the small-width magazine 35.

Figure 3:
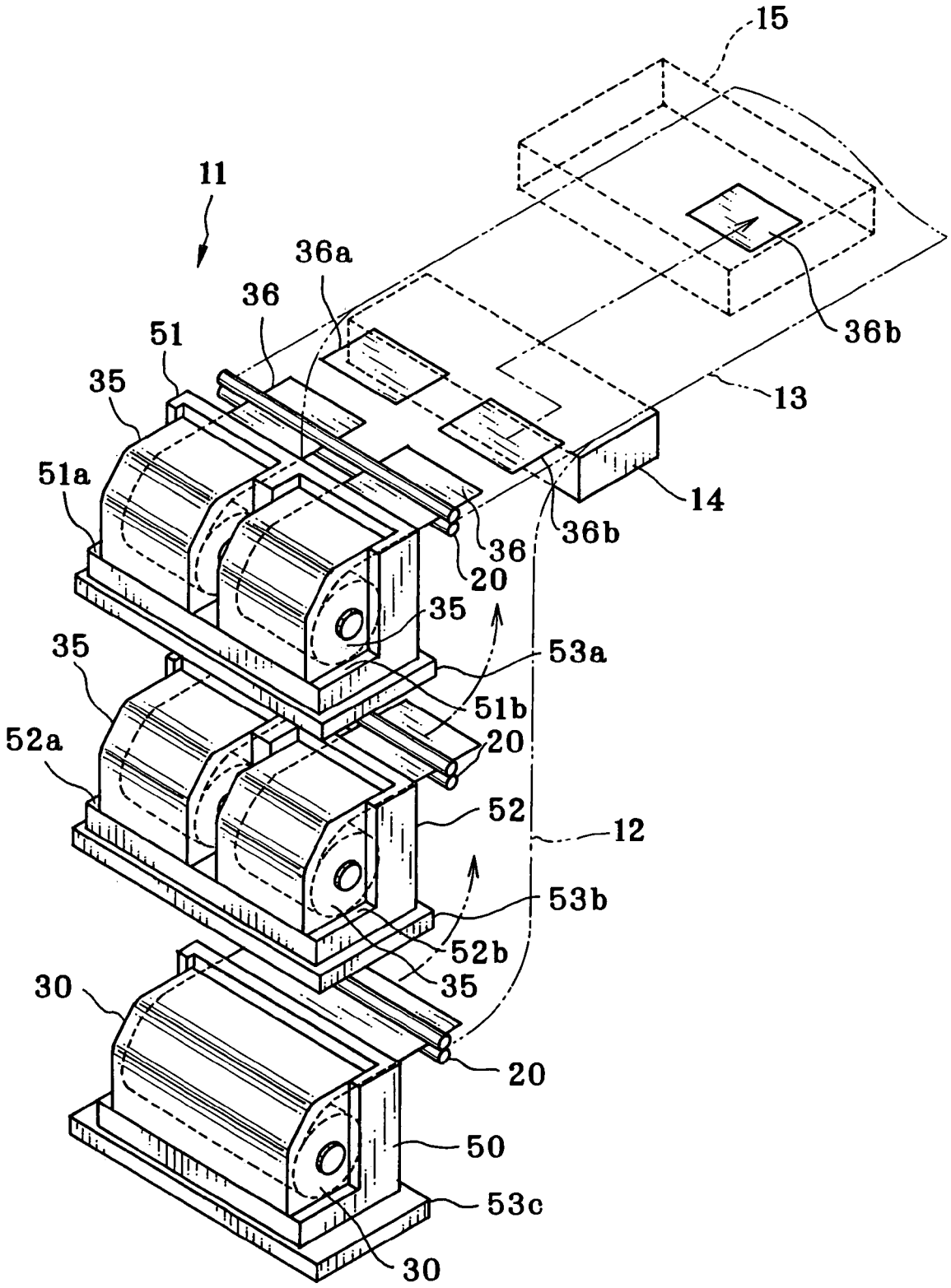
FIG. 3 is a perspective view illustrating a supply device for the photographic paper.

In FIG. 3, the recording material supply device 11 includes a large-width loading support 50, two small-width loading supports 51 and 52, and retaining mechanisms 53*a*, 53*b* and 53*c*. The large-width loading support 50 as a first loading unit is loaded with the large-width magazine 30 removably. The small-width loading supports 51 and 52 as a second loading unit are loadable with the two small-width magazines 35 removably. The retaining mechanisms 53*a*, 53*b* and 53*c* keep the small-width loading supports 51 and 52 and the large-width loading support 50 retained in a stationary manner. Two loading regions 51*a* and 51*b* are defined in the small-width loading support 51 for setting the small-width magazines 35 which are arranged in the second direction or path crosswise direction of the transporting path 13. Similarly, two loading regions 52*a* and 52*b* are defined in the small-width loading support 52 for setting the small-width magazines 35 which are arranged in the second direction. A cutter 55 is incorporated in each of the loading supports 50, 51 and 52, and cuts the photographic paper advanced from the magazines into a sheet in a predetermined printing size.

The retaining mechanisms 53*a*–53*c* are arranged vertically over one another. The retaining mechanism 53*c* is disposed the lowest, and retains the large-width loading support 50. The retaining mechanism 53*a* is disposed the highest, and retains the small-width loading support 51. The retaining mechanism 53*b* is disposed at the middle level, and retains the small-width loading support 52. Thus, a series of the small-width loading supports 51 and 52 and the large-width loading support 50 is disposed to extend in the first direction, which is vertical to the path crosswise direction or second direction.

In each of the retaining mechanisms 53*a*, 53*b* and 53*c*, an information reader 64 or RFID tag reader is incorporated, and is connected with the controller 19. When the large and small-width magazines 30 and 35 are loaded in the large-width loading support 50 and the small-width loading supports 51 and 52, information stored in the identification storage mediums 40 and 41 is read by the information reader 64 through the loading supports 50, 51 and 52 in the retaining mechanisms 53*a*, 53*b* and 53*c*, and is sent to the controller 19. Then the controller 19 retrieves the information, and detects the position of the large and small-width magazines 30 and 35 being loaded.

The shifting distributor 14 causes the photographic paper sheet from the recording material supply device 11 to move in the path crosswise direction on the transporting path 13. To shift the photographic paper, the shifting distributor 14 is controlled for the shift to a position of optimizing the exposure in an exposing region of the image forming exposure device 15, for example to the center of the exposing region.

Figure 4:
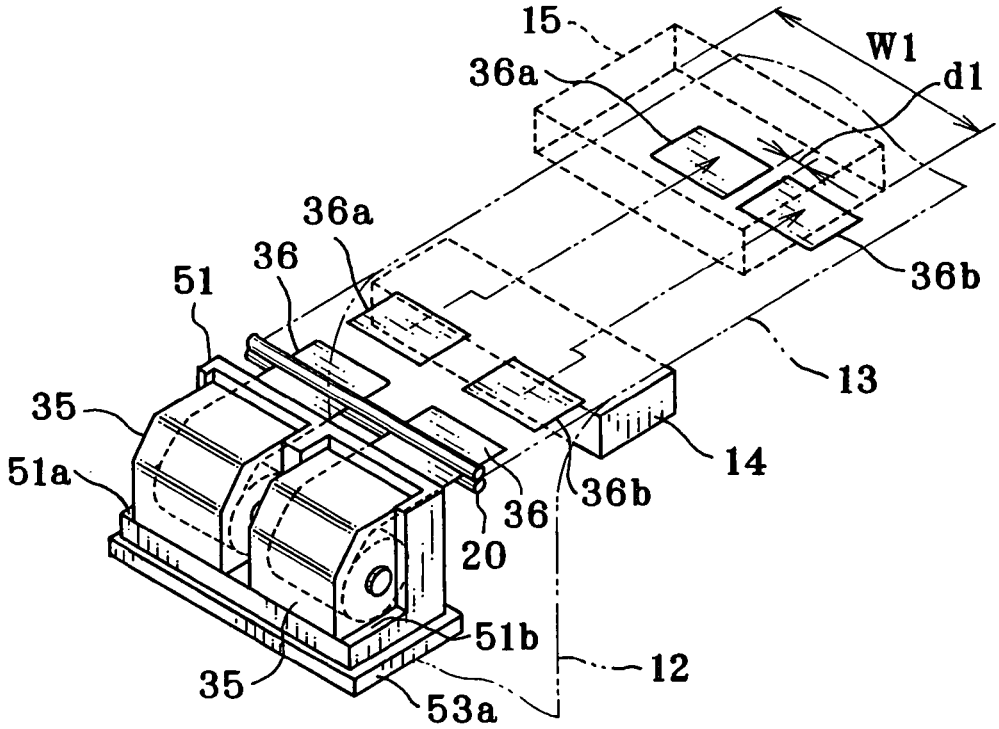
FIG. 4 is a perspective view illustrating a state of using two small-width magazines with photographic paper different in the web width.
Figure 5:
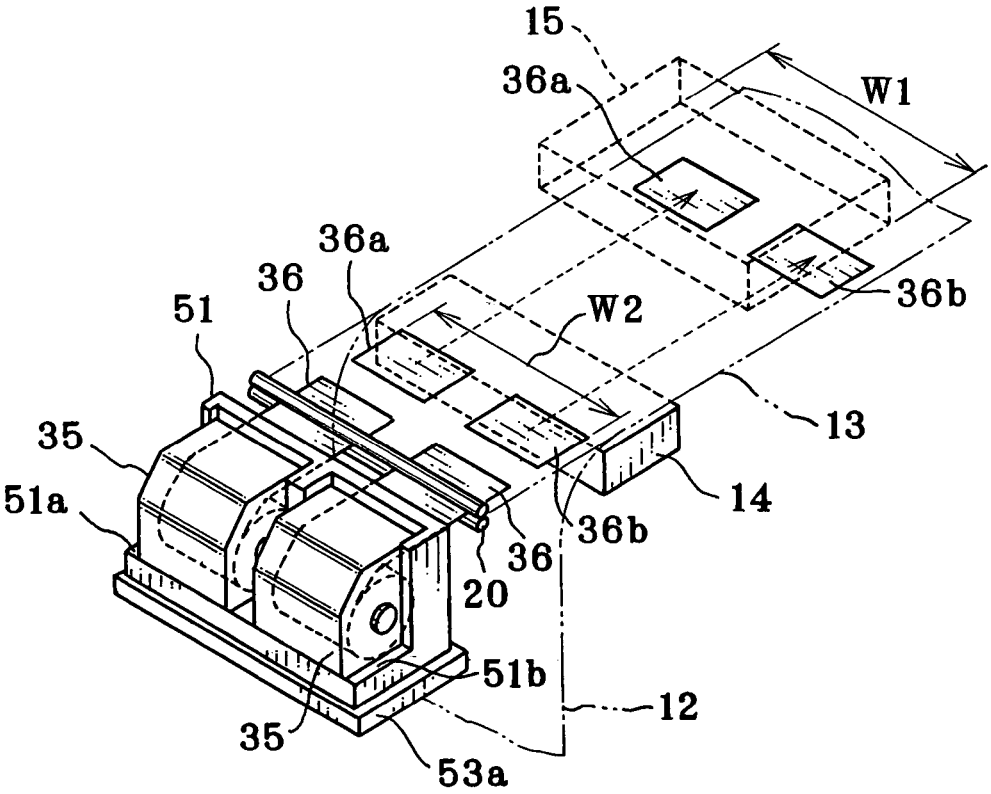
FIG. 5 is a perspective view illustrating of using two small-width magazines positioned in consideration of simultaneous exposure for recording sheets.

The operation of the printer-processor composite machine 10 constructed above is described now by referring to FIGS. 3–5. The controller 19 receives command signals from the input key panel 22 for the command of image recording intended by an operator. The information of various items related to the photographic paper 31 and 36 is retrieved from the large and small-width magazines 30 and 35 on the loading supports 50, 51 and 52, the information including the photographic paper type, the width, the remaining amount, the initial date of the use, and the like. Furthermore, the positions of the loading of the large and small-width magazines 30 and 35 are detected.

The controller 19 determines from which of the large and small-width magazines 30 and 35 the photographic paper should advance according to the magazine position and the size of an image to be printed. Then photographic paper is caused by the controller 19 to advance from a selected one of the magazines. The following is description of delivering the photographic paper 36 by taking an example of the small-width magazines 35 loaded in the small-width loading support 51 disposed the highest.

If the web widths of the photographic paper 36 are different between the small-width magazines 35 on the small-width loading support 51, the photographic paper 36 is unwound from the small-width magazine 35 in the loading region 51*b*, and is cut by the cutter 55 at a predetermined length, to obtain a photographic paper sheet 36*b*. The paper sheet 36*b* moves through the transporting path 13 to the shifting distributor 14. The shifting distributor 14 shifts the paper sheet 36*b* to the center of the transporting path 13 as indicated by the phantom lines in FIG. 3, before the paper sheet 36*b* is transported through the transporting path 13 to the image forming exposure device 15.

Furthermore, zigzag traveling of sheets can be produced. The two small-width magazines 35 are used to advance of the photographic paper 36, which is cut to obtain a photographic paper sheets 36*a* and 36*b* which are different in the web width or size. The paper sheets 36*a* and 36*b* are sorted by the shifting distributor 14 into two rows and with a zigzag, and transported to the image forming exposure device 15. In FIG. 4, an additional preferred embodiment is illustrated. The paper sheets 36*a* and 36*b* are different in the web width, but have ranges of which a sum is equal to or smaller than W1 which is the maximum width recordable with the exposure device 15. For example, W1=315 mm. As indicated by the phantom lines in FIG. 4, the shifting distributor 14 operates to reduce the interval between the paper sheets 36*a* and 36*b* to a regular interval d1, causes their transport to the exposure device 15, where two images are exposed at the same time.

As the width of the photographic paper 36 is equal between the small-width magazine 35 on the small-width loading support 51, webs of the photographic paper 36 are simultaneously advanced from the small-width magazines 35, and are cut at a predetermined length by the cutter 55. The photographic paper sheets 36*a* and 36*b* are obtained, and transported through the transporting path 13 to the shifting distributor 14. As indicated by the phantom lines in FIG. 4, the shifting distributor 14 reduces the interval between the paper sheets 36*a* and 36*b* to the prescribed interval d1, so the paper sheets 36*a* and 36*b* are transported to the image forming exposure device 15 in parallel, and exposed at the same time. In the embodiment, the advance and the cutting of the photographic paper 36 are simultaneous between the two small-width magazines 35. It is possible to shorten the drawing time and the cutting time. Efficiency of printing per unit time can be raised considerably. It is advantageous to select a most frequently usable paper roll type for the photographic paper 36, because the number of prints to be produced can be twice as high as before. Speed of production, in other words efficiency can be twice as high.

It is necessary to shift the photographic paper sheets 36*a* and 36*b* nearer to each other at the interval d1 in the shifting distributor 14 if the webs of the photographic paper 36 have the equal web width between the small-width magazines 35. In FIG. 5, an alternative structure is depicted. The webs of the photographic paper 36 have a sufficiently small web width. Let W2 be a widthwise range where the paper sheets 36*a* and 36*b* extend within the entirety of the transporting path 13. If W2 is equal to or smaller than W1 as the maximum exposing width of the image forming exposure device 15, it is unnecessary to shift the paper sheets 36*a* and 36*b* nearer to each other. As indicated by the broken lines in FIG. 5, the paper sheets 36*a* and 36*b* are transported to the exposure device 15 and exposed simultaneously. There is no operation of the shifting distributor 14 for widthwise shift of the sheets.

As described above, the photographic paper sheets 36*a* and 36*b* are transported to the image forming exposure device 15, which scans and exposes those to form an image in a latent image form according to image data. The image data may be such obtained by reading of image frames in photo film in a photo film scanner (not shown), or such input by means of a memory card as an external storage medium. The paper sheets 36*a* and 36*b* are subjected in the processing bath group 16 to color development, bleach/fixing and water washing, and are dried by the drier 17. The paper sheets 36*a* and 36*b* are transported to the stacker 18, which sorts and ejects the paper sheets 36*a* and 36*b* per customer orders.

Note that the image forming exposure device 15 according to the embodiment digitally operates for exposure by scanning according to image data. However, a printing system of the present invention may be a direct exposure in which printing light is applied to the original photo film, for applying transmitted light to the photographic paper for printing the image.

In the above description, supply of the photographic paper 36 from the uppermost level of the small-width loading support 51 is referred to for the small-width magazines 35. However, the operation is the same for the supply of the photographic paper 36 from the middle height of the small-width loading support 52 for the small-width magazines 35. Also, it is possible to advance the photographic paper 36 from the small-width magazine 35 in the loading region 51*a* of the small-width loading support 51 and from the small-width magazine 35 in the loading region 52*a* of the small-width loading support 52 at the same time. Furthermore, the most preferable transport in the two row on the transporting path 13 is to advance the photographic paper 36 from the small-width magazine 35 in the loading region 51*a* of the small-width loading support 51 and from the small-width magazine 35 in the loading region 52*b* of the small-width loading support 52. In other words, it is desirable to designate two diagonally arranged positions from the loading regions 51*a*, 51*b*, 52*a* and 52*b* for the double-row transport.

If it is desired to advance the photographic paper 31 from the large-width magazine 30 loaded in the large-width loading support 50 disposed the lowest, the photographic paper 31 is unwound at a predetermined length according to the image size for printing, and cut by the cutter 55. A paper sheet obtained from the photographic paper 31 is transported to the image forming exposure device 15 without shifting in the shifting distributor 14. The photographic paper 31 is subjected to the image forming the same as that for the small-width magazines 35.

The plural magazines for containing the photographic paper of two or more types are settable at the same time. It is unnecessary to exchange the magazines if a change in the size of the photographic paper is desired. Furthermore, the plural magazines for containing the photographic paper of one common type are settable at the same time. It is possible to produce photographic prints of the same size for a considerably long time without exchanging the magazines, because changeover is possible from one magazine to another.

Also, the width of the magazine for containing the photographic paper with the small web width is determined small. It is possible to exchange magazines easily. A plurality of magazines can be loaded in the image forming apparatus. The number of spare magazines can be small, so as to save the space required for preservation of accessory articles.

In the above embodiment, each of the small-width magazines 35 has a size to contain photographic paper having a width of at most 152 mm. However, it is possible in the small-width magazines 35 that the width of the magazine body 38 is small, and is suitable for containing photographic paper having a width of 102 mm or less, or photographic paper having a width of 127 mm (L-size width) or less. Such a small size makes it possible to arrange three or more of the small-width magazines 35 in the path crosswise direction of the transporting path 13. The small-width loading supports 51 and 52 may be constructed for a set of three arranged ones of the small-width magazines 35 at one time. Three or more of sheets of the photographic paper 36 can be transported in parallel through the transporting path 13.

Figure 6:
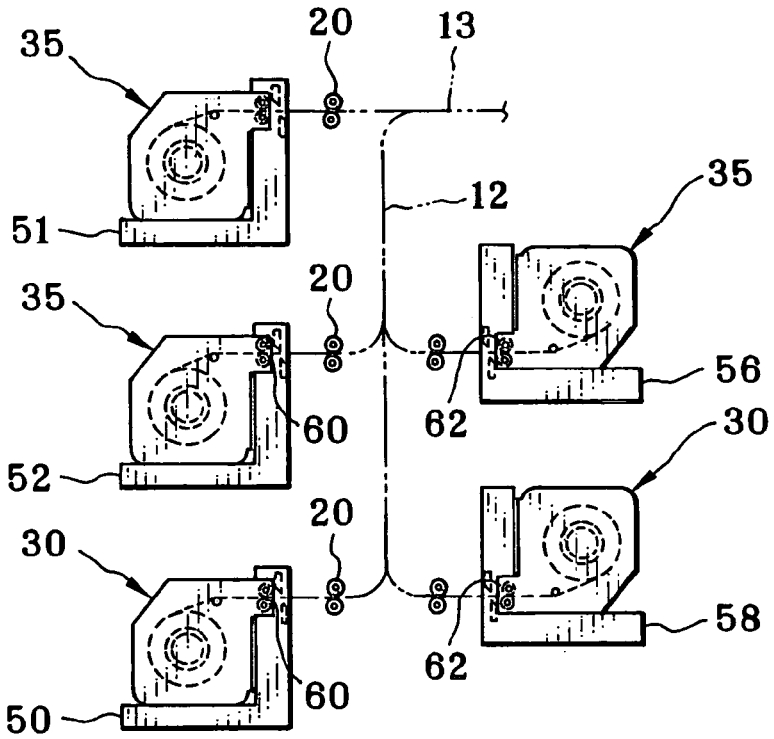
FIG. 6 is an explanatory view in elevation, illustrating one preferred supply device with five loading units.

In the above embodiment, the small-width loading supports 51 and 52 and the large-width loading support 50 are arranged vertically in three levels. However, a plurality of loading supports may be arranged in two levels or four or more levels in the vertical direction. In FIG. 6, another preferred disposition of the loading supports is illustrated. A large-width loading support 58 as a first loading unit is disposed at a second lowest level higher than the large-width loading support 50, but lower than the small-width loading support 52. An ejection channel 62 of the large-width magazine 30 set on the large-width loading support 58 is directed toward an ejection channel 60 of the large-width magazine 30 set on the large-width loading support 50. A small-width loading support 56 as a second loading unit is disposed at a level between those of the small-width loading supports 51 and 52. The small-width loading support 56 is directly above the large-width loading support 58, so that the small-width loading support 56 and the large-width loading support 58 constitute a second group of loading supports on one side split by the transporting path 12.

Figure 7:
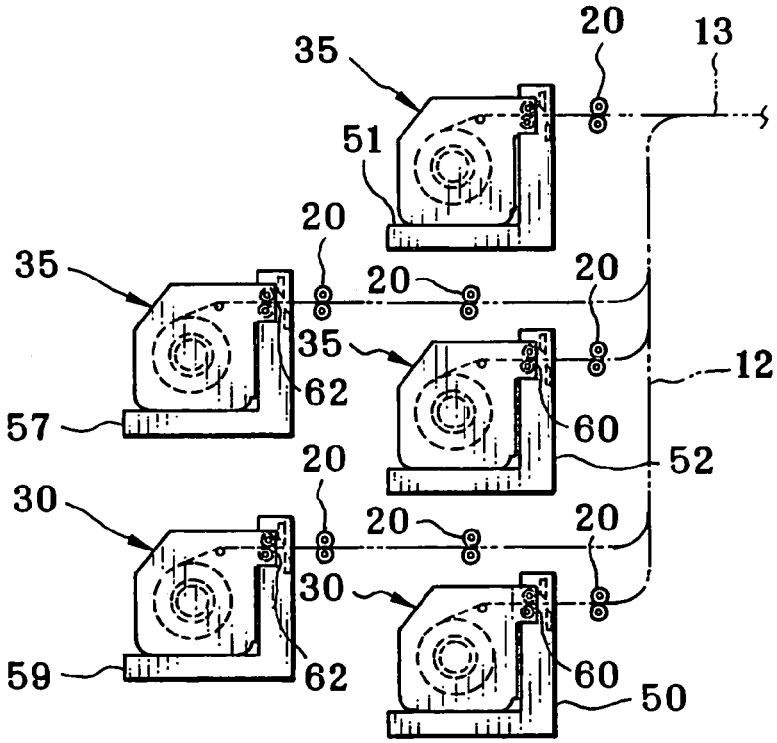
FIG. 7 is an explanatory view in elevation, illustrating another preferred supply device with five loading units but for transport in the same direction.

In FIG. 7, still another preferred disposition of the loading supports is illustrated. A large-width loading support 59 as a first loading unit is disposed at a second lowest level higher than the large-width loading support 50, but lower than the small-width loading support 52. The large-width loading support 59 is offset horizontally from the large and small-width loading supports 50 and 52. A small-width loading support 57 as a second loading unit is disposed at a level between those of the small-width loading supports 51 and 52. The small-width loading support 57 is directly above the large-width loading support 59, so that the small-width loading support 57 and the large-width loading support 59 constitute a second group of loading supports. According to those two dispositions, a great number of magazines, as many as five, can be loaded in the image forming apparatus.

In FIG. 6, the large and small-width loading supports 50–52, 56 and 58 are disposed in the five levels determined with differences vertically. Among the five, the two large-width loading supports 50 and 58 are disposed at the lower levels. The three small-width loading supports 51, 52 and 56 are disposed at the upper levels. However, it is possible among the five to dispose the two or three small-width loading supports 51, 52 and 56 at the lower levels. The two or three large-width loading supports 50 and 58 may be disposed at the upper levels. The same applies in the structure of FIG. 7.

Also, each of the loading supports 50, 51 and 52 can be constructed as a unit which can be handled as a single block. The small-width loading supports 51 and 52 and the large-width loading support 50 can be set on the retaining mechanisms 53*a*, 53*b* and 53*c* in a removable manner. If the combination of selected ones of the loading supports 50, 51 and 52 is changed, an operator is enabled to select various settings. This is remarkably advantageous if the size of the photographic paper is changed much frequently.

It is to be noted that the large-width magazine 30, in spite of the structure specialized for the photographic paper 31, can have a compatible structure loadable with the photographic paper 36 associated with the small-width magazines 35. The paper roll 37 of the photographic paper 36 has an outer diameter of 300 mm, in consideration of which the large-width magazine 30 can be shaped in a general-purpose manner.

In the above embodiments, the printer-processor composite machine 10 operates for recording an image. However, an image forming apparatus of the invention can be any of known types, such as inkjet printer, thermal printer, thermal transfer printer, apparatus of an electrophotographic structure or a laser printer, and other various image forming apparatuses.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording material supply device for removably holding a magazine for containing a recording material roll of recording material, and for advancing and supplying said recording material from said magazine to a transporting path where an image forming device is disposed, said recording material supply device comprising:

a first loading unit for being loaded with a large-width magazine removably, said large-width magazine being adapted to containing a large-web-width type of said recording material roll; and a second loading unit, disposed beside said first loading unit in a first direction that is perpendicular to a transporting surface of said transporting path, for being loaded with plural small-width magazines removably, said small-width magazines being adapted to containing a small-web-width type of said recording material roll having a smaller width than said large-web-width type of said recording material roll, and being arranged in a second direction that extends along an axis of said recording material roll in said first loading unit.

2. A recording material supply device as defined in claim 1, wherein each of said large and small-width magazines includes a support shaft for supporting said recording material roll in a rotatable manner.

3. A recording material supply device as defined in claim 2, further comprising plural transporting mechanisms for transporting said recording material from each of said large and small-width magazines.

4. A recording material supply device as defined in claim 3, further comprising a cutter for cutting said recording material to form a recording sheet.

5. A recording material supply device as defined in claim 4, wherein said first and second loading units have respectively a unitary form;

further comprising a retaining mechanism for removably retaining said first and second loading units.

6. A recording material supply device as defined in claim 3, wherein said large and small-width magazines include a storage medium for storing information related to said recording material; and each of said first and second loading units includes an information reader for reading said information from said storage medium.

7. A recording material supply device as defined in claim 3, wherein said recording material of said small-width magazines is different in a width to one another.

8. A recording material supply device as defined in claim 3, wherein said recording material of said small-width magazines is equal in a width to one another.

9. A recording material supply device as defined in claim 8, wherein said plural small-width magazines include first and second small-width magazines;

further comprising a controller for controlling said plural transporting mechanisms, for causing said recording material to advance from said first small-width magazine, and for causing said recording material to advance from said second small-width magazine continuously after using up of said recording material from said first small-width magazine.

10. A recording material supply device as defined in claim 3, wherein said first direction is substantially vertical, and said small-width magazines are arranged in two or more groups in a series extending substantially vertically.

11. A recording material supply device as defined in claim 10, wherein said two or more groups of said small-width magazines comprise at least first, second and third groups;

said second group is disposed substantially above said first group, and said third group is disposed at a height between heights of said first and second groups, and offset therefrom horizontally.

12. A recording material supply device as defined in claim 3, wherein a first recording material in said large-width magazine has a first width, and a second recording material in said small-width magazines has a second width smaller than said first width;

said large-width magazine is adapted to contain any of said first and second recording materials.

13. A recording material supply device as defined in claim 3, wherein a roll diameter of said roll of said recording material in said small-width magazines is greater than a roll diameter of said roll of said recording material in said large-width magazine.

14. A recording material supply device as defined in claim 3, wherein said plural small-width magazines include two or three small-width magazines.

15. A recording material supply device as defined in claim 1, wherein said plural small-width magazines comprise first and second small-width magazines;

said first and second small-width magazines include respectively first and second exit channels for advancing said recording material;

said second loading unit includes:

a first support for supporting said first small-width magazine;

a second support for supporting said second small-width magazine by directing said second exit channel to said first exit channel of said first small-width magazine on said first support;

an aligning mechanism for bending a path of a first recording material from said first exit channel in a first bending direction, for bending a path of a second recording material from said second exit channel in a second bending direction reverse to said first bending direction, to align and guide said first and second recording materials toward said transporting path.

16. A recording material supply device as defined in claim 1, wherein said plural small-width magazines comprise first and second small-width magazines;

said first and second small-width magazines include respectively first and second exit channels for advancing said recording material;

said second loading unit includes:

a first support for supporting said first small-width magazine;

a second support, positioned at a different height from said first support and offset therefrom substantially horizontally, for supporting said second small-width magazine by directing said second exit channel substantially in parallel with said first exit channel of said first small-width magazine on said first support.

17. A recording material supply device as defined in claim 1, wherein said first and second loading units are arranged in a third direction that is perpendicular to both of said first and second directions.

18. An image forming apparatus for removably holding a magazine for containing a recording material roll of recording material, for advancing and supplying said recording material from said magazine to a transporting path where an image forming device is disposed, and for image forming on said recording material by use of said image forming device, said image forming apparatus comprising:

a first loading unit for being loaded with a large-width magazine removably, said large-width magazine being adapted to containing a large-web-width type of said recording material roll;

a second loading unit, disposed beside said first loading unit in a first direction that is perpendicular to a transporting surface of said transporting path, for being loaded with plural small-width magazines removably, said small-width magazines being adapted to containing a small-web-width type of said recording material roll having a smaller width than said large-web-width type of said recording material roll, and being arranged in a second direction that extends along an axis of said recording material roll in said first loading unit; and a shifting mechanism, positioned upstream from said image forming device, for shifting said recording material in said second direction on said transporting path for position adjustment.

19. An image forming apparatus as defined in claim 18, further comprising a cutter for cutting said recording material to form a recording sheet;

wherein said shifting mechanism shifts said recording sheet.

20. An image forming apparatus as defined in claim 19, wherein each of said large and small-width magazines includes a support shaft for supporting said recording material roll in a rotatable manner.

21. An image forming apparatus as defined in claim 20, further comprising plural transporting mechanisms for transporting said recording material from each of said large and small-width magazines.

22. An image forming apparatus as defined in claim 21, wherein said first and second loading units have respectively a unitary form;

further comprising a retaining mechanism for removably retaining said first and second loading units.

23. An image forming apparatus as defined in claim 21, wherein said large and small-width magazines include a storage medium for storing information related to said recording material; and each of said first and second loading units includes an information reader for reading said information from said storage medium.

24. An image forming apparatus as defined in claim 21, wherein said first direction is substantially vertical, and said small-width magazines are arranged in two or more groups in a series extending substantially vertically.

25. An image forming apparatus as defined in claim 21, wherein said recording material of said small-width magazines is different in a width to one another.

26. An image forming apparatus as defined in claim 25, wherein said cutter produces said recording sheet by cutting said recording material from one of said small-width magazines, and said shifting mechanism distributes said recording sheet into plural rows for supply to said image forming device.

27. An image forming apparatus as defined in claim 21, wherein said recording material of said small-width magazines is equal in a width to one another.

28. An image forming apparatus as defined in claim 27, wherein said plural small-width magazines include first and second small-width magazines;

further comprising a controller for controlling said plural transporting mechanisms, for causing said recording material to advance from said first small-width magazine, and for causing said recording material to advance from said second small-width magazine continuously after using up of said recording material from said first small-width magazine.

29. An image forming apparatus as defined in claim 21, wherein said shifting mechanism sets said recording sheet from said small-width magazines on a centerline of said recording sheet from said large-width magazine.

30. An image forming apparatus as defined in claim 21, wherein plural recording sheets in series in said second direction are subjected to image forming simultaneously by said image forming device.

31. An image forming apparatus as defined in claim 30, wherein said transporting mechanisms transport a plurality of said recording material from said plural small-width magazines toward said image forming device with an interval between said plurality of said recording material unchanged in said second direction.

32. An image forming apparatus as defined in claim 31, wherein said image forming device includes a maximum recordable widthwise range equal to or greater than a widthwise range where plural recording materials from said plural small-width magazines has on said transporting path, said maximum recordable widthwise range being defined where said image forming device is capable of image forming.

33. An image forming apparatus as defined in claim 30, wherein said shifting mechanism reduces an interval between plural recording sheets according to said second direction before said image forming device operates.

34. An image forming apparatus as defined in claim 21, wherein said shifting mechanism causes transport of said recording sheet in a zigzag form in plural rows.

35. An image forming apparatus as defined in claim 21, wherein said small-width magazines comprises four small-width magazines disposed in a 2×2 matrix according to said first and second directions;

further comprising a controller for controlling said transporting mechanisms to transport said recording materials simultaneously from two of said four small-width magazines arranged diagonally with respect to said matrix.

* * * * *